US005321925A

United States Patent [19]

Kaneko et al.

[11] Patent Number: 5,321,925

[45] Date of Patent: Jun. 21, 1994

[54] MULTISTORY BUILDING

[75] Inventors: Yoshio Kaneko; Shigeru Akiyama, both of Tokyo, Japan

[73] Assignee: Shimizu Construction Co, Ltd., Tokyo, Japan

[21] Appl. No.: 98,207

[22] Filed: Jul. 28, 1993

[30] Foreign Application Priority Data

Jul. 29, 1992 [JP] Japan ..... 4-202750

[51] Int. Cl.[5] ..... E04H 3/00

[52] U.S. Cl. ..... 52/236.2; 52/236.3; 52/79.3

[58] Field of Search ..... 52/236.2, 236.3, 234, 52/236.4, 79.3, 167 R, 73, 169.1

[56] References Cited

U.S. PATENT DOCUMENTS 2,172,838 9/1939 Flato ..... 52/236.4
3,331,168 7/1967 Frey ..... 52/73
3,529,386 9/1970 Ostendorf ..... 52/79.3

FOREIGN PATENT DOCUMENTS 679826 1/1930 France ..... 52/236.2

*Primary Examiner*—James L. Ridgill, Jr.
*Attorney, Agent, or Firm*—Thompson, Hine and Flory

[57] ABSTRACT

A multistory building comprising a plurality of units which are disposed connectedly and side by side and stand along a horizontal standard line, is disclosed. The units comprise two groups, wherein one of the two groups is tilted in one direction and the other of the two groups is tilted in the opposite direction so that the moments according to the weights of the two groups of units cancel each other.

13 Claims, 4 Drawing Sheets

MULTISTORY BUILDING

BACKGROUND OF THE INVENTION

1. Field of the Invention

The present invention relates to a multistory building comprising a plurality of units which are disposed connectedly, side by side, and stand along a horizontal standard line.

2. Related Art

Recently, the construction of high-rise building has become common in Japan. Early high-rise buildings were of monolithic rectangular parallelopiped shapes, whereas, at present, high-rise buildings are of more varied in form. It becomes a subject of public notice when a high-rise building with a new distinctive design, never before seen, is erected.

The shape of conventional high-rise buildings cannot deviate from one or an aggregate of square columns, circular columns, or conical or pyramidal columns.

In view of the above circumstances, the concept of a high-rise building having a tilted building frame such as "the Leaning Tower of Pisa", would be highly attention-attracting.

If standard floors in a conventional building were simply stacked progressively displaced in one direction, i.e., in a non-perpendicular manner, in order to construct a building with a tilted building frame, problems such as the following would occur.

1. Forces in the building caused by the tilt of the building always act on the building in an unbalanced manner.

2. It is difficult to vertically provide shafts for stairs, elevators, pipes, or the like.

3. Since the shapes and areas of the living spaces are apt to be different in each story, use of the building is complicated.

Therefore, in order to realize a high-rise building which will have a great visual impact on the viewer, it is necessary to solve the above problems.

SUMMARY OF THE INVENTION

The present invention was developed in view of the above-described problems.

It is an object of the present invention to provide a multistory building having a striking appearance, without compromising structural safety.

In order to achieve the above described object of the present invention, a multistory building is provided comprising a plurality of units which are disposed connectedly and side by side and stand along a horizontal standard line, wherein the units comprise two groups, each unit in one of the two groups being tilted in one direction and each unit in the other of the two groups being tilted in the opposite direction so that the forces in the two groups of units cancel each other.

Since each unit of the multistory building of the present invention is tilted with respect to the vertical axis so as to have one upper inclined face and one lower inclined face, the building of the present invention provides an appearance of a multistory building of striking visual appearance. Furthermore, according to the multistory building of the present invention, since the moments caused by the tilt of the groups which act upon the units of the groups in falling down directions thereof cancel each other, it is possible to provide a structurally stable multistory building. Since the outside units and the intermediate unit are coupled with one another in a horizontal standard line, it is possible to secure the horizontal rigidity.

Preferably, the multistory building comprises three or more units. Furthermore, it is preferable that the units comprise at least two outside units and an intermediate unit so that the moments caused by the tilt of the outside units and caused by the tilt of the intermediate unit cancel each other.

According to the multistory building of the present invention, since the moments caused by the tilt of the outside units and caused by the intermediate unit cancel each other, it is possible to provide a structurally stable multistory building.

Preferably, a core portion extending vertically is provided in at least one unit in the portion on which the adjacent units overlap each other in side view, the core portion having a common facility for the multistory building which includes a facility for vertical transport in the multistory building.

According to the multistory building, it is possible to provide an vertical transport means or pipes vertically in the core portion. Therefore, this multistory building is advantageous for construction of these facilities and for effective use of the transport apparatuses or the like provided inside of the building. The multistory building of the present invention does not adversely affect the design of the living space.

Preferably, a brace structure for supporting the forces in the horizontal direction which operate on both the adjacent units is provided between the adjacent units, the brace structure comprising a plurality of chord members provided opposite to each other and a plurality of braces provided between the chord members so that the portion on which the adjacent units overlap each other in side view is surrounded by the brace structure in side view.

The brace structure counteracts the forces in the horizontal direction which operate between the units to secure the horizontal rigidity. Therefore, it is possible to secure the freedom of shape of living rooms in each story and of the core portion structurally, to rationally divide the living rooms for construction and make effective use thereof, and to prevent exposure of diagonal members in rooms.

DETAILED DESCRIPTION OF THE PREFERRED EMBODIMENTS

Figure 1:
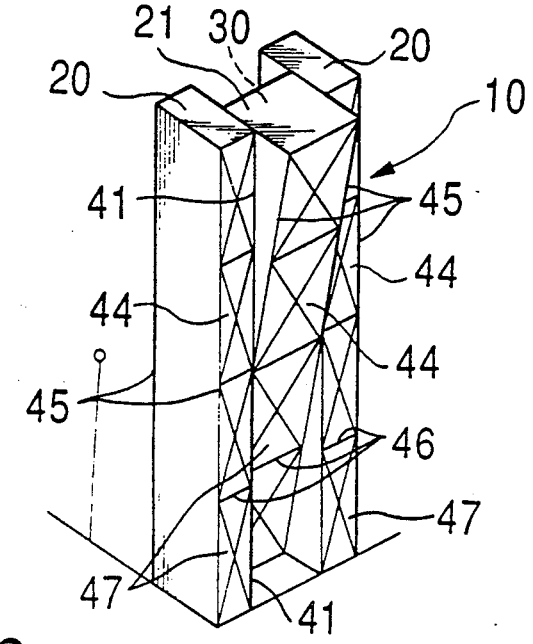
FIG. 1 is a perspective view showing an embodiment of the present invention.

Hereinafter, an embodiment of the present invention will be explained with reference to FIGS. 1–7.

In these FIGS., numeral 10 denotes a multistory building of the embodiment; numeral 20 denotes outside units which comprise a part of the multistory building 10; numeral 21 denotes an intermediate unit which comprise a part of the multistory building 10; numeral 30 denotes a core portion of the multistory building 10; numeral 40 denotes a brace structure for supporting the forces in the horizontal and vertical directions which operate the units 20, 20 and 21, and for securing the horizontal rigidity of the building 10; numeral 41 denotes chord members of the brace structure 40; and numeral 42 denotes braces of the brace structure 40.

Figure 2:
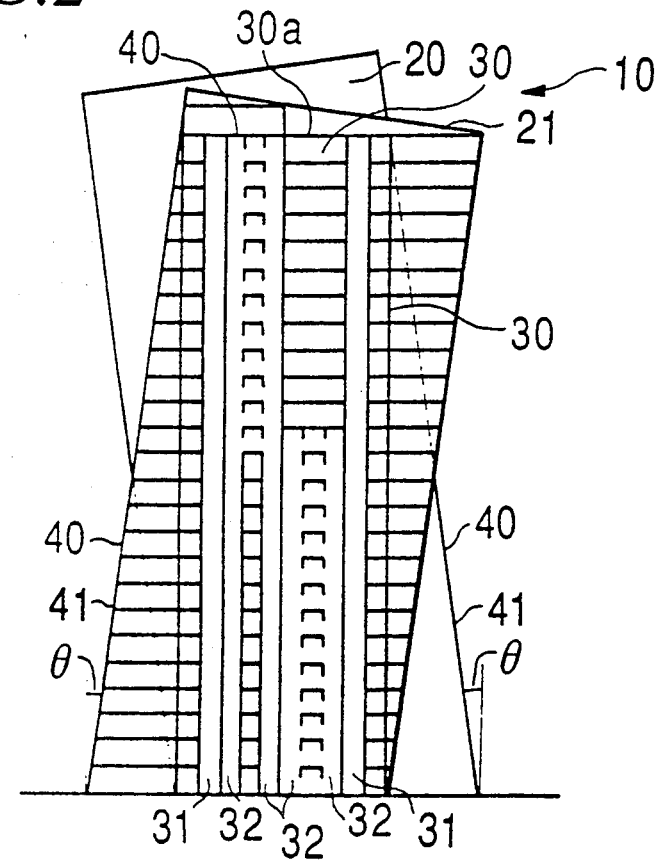
FIG. 2 is a vertical longitudinal sectional view showing the embodiment of the present invention.

FIG. 1 is a perspective view and FIG. 2 is a side view showing an embodiment of the present invention. As shown in FIG. 1, the multistory building 10 comprises three units consisting of two groups which are disposed connectedly and side by side. One of the two groups comprises a pair of outside units 20 and 20 which are erected at a distance from each other. The other of the two groups comprises an intermediate unit 21 which is erected between the pair of outside units 20 and 20. The outside units 20 and the intermediate unit 21 are made of steel, reinforced concrete or the like. The total weight of the outside units 20 and 20 and the weight of the intermediate unit 21 are approximately equal.

As shown in FIG. 2, the outside and intermediate units 20 and 21 are generally of a non-right parallelopiped shape at the lower portion of the units and of a right parallelopiped at the upper portion of the units. Both the outside units 20 and 20 of the multistory building 10 are tilted at the same predetermined angle $\theta$ with respect to the vertical axis in side view so as to have one upper inclined face and one lower inclined face. On the other hand, the intermediate unit 21 is tilted at the same angle $\theta$ as that of the outside units 20 in the opposite direction with respect to the vertical axis. That is, the units 20 and 21 comprising two groups are tilted with respect to the vertical axis in opposite directions so that the forces of the two groups of the building caused by the tilt of the building units cancel each other.

The outside units 20 and 20 are of similar construction, each of which has a rectangular shape in sectional view. Each of the outside units 20 and 20 has a shape so that if the pair of outside units 20 and 20 were laterally combined correspondingly, they would constitute a unit having a similar size and shape as that of the intermediate unit 21. The intermediate unit 21 has a rectangular shape in transverse sectional view, the area of which is approximately equal to the sum of the sectional area of both the outside units 20 and 20.

Figure 3:
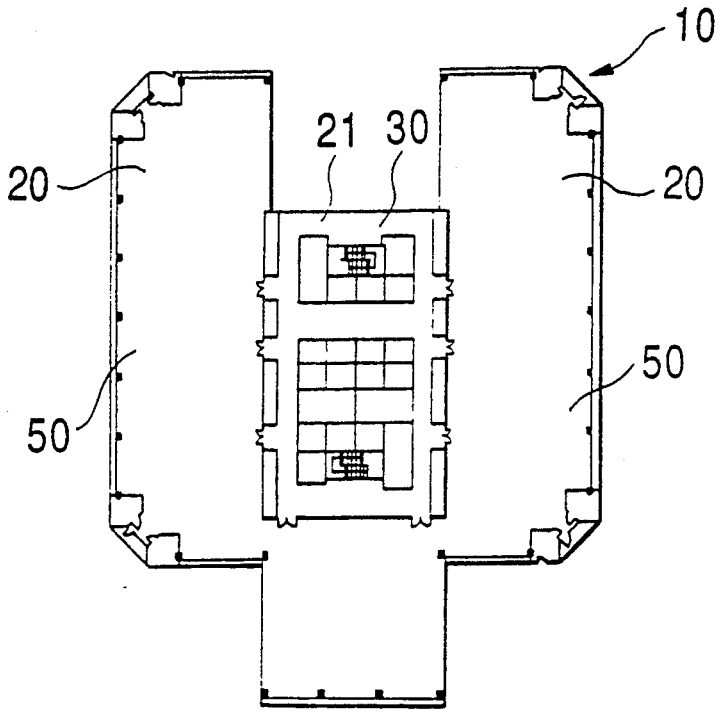
FIG. 3 is a plan view showing the first floor of the multistory building shown in FIGS. 1 and 2.
Figure 4:
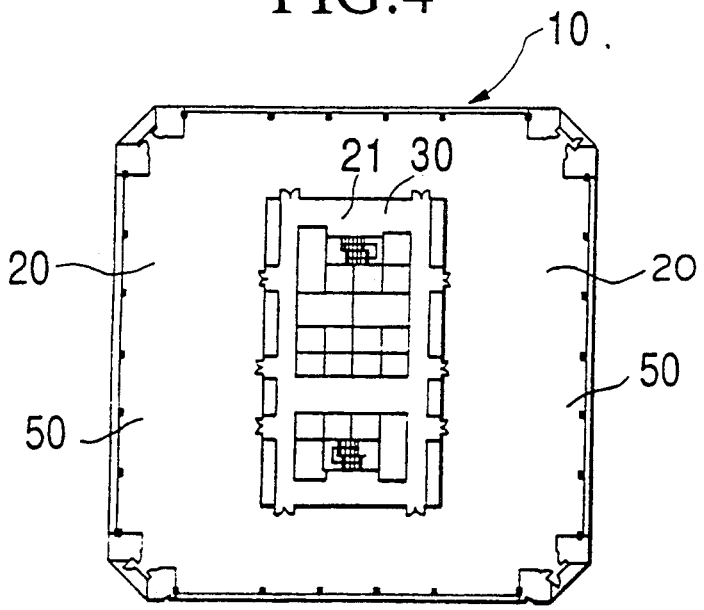
FIG. 4 is a plan view showing the middle floor of the multistory building shown in FIGS. 1 and 2.
Figure 5:
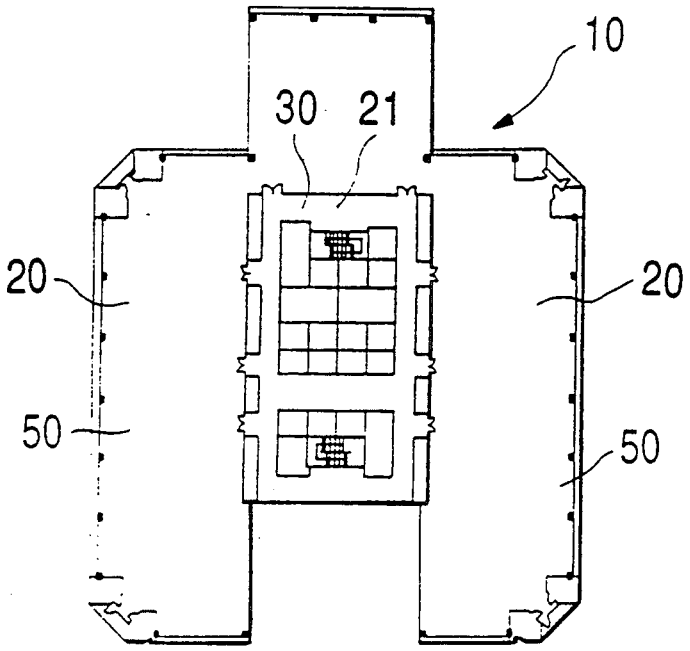
FIG. 5 is a plan view showing the top floor of the multistory building shown in FIGS. 1 and 2.

FIGS. 3–5 are plan views showing the first floor, the middle floor, and the top floor of the multistory building shown in FIGS. 1 and 2, respectively. A core portion 30 extending vertically is provided in the intermediate unit 21, in the portion on which the outside units 20 and 20 and the intermediate unit 21 overlap each other in side view, as shown in FIGS. 2–5. In the core portion 30, common facilities for the multistory building, e.g., stairs 31, elevators 32 or the like, are provided.

The core portion 30 has a rectangular parallelopiped shape which is a divided part of the inside of the intermediate unit 21 of the multistory building 10 surrounded by a brace structure 40, as shown in FIGS. 2–5. The core portion 30 has a top horizontal end portion 30*a* with the same height as that of the lower edge of the top surface of the tilted unit 21. Inside the core portion 30, vertically extending stairs 31 and elevators 32, for the entirety of the multistory building 10 are provided. A pipe shaft for disposing pipes for the multistory building 10 can be provided along the stairs 31 and the elevators 32 in the core portion 30. The core portion 30 is positioned at the center portion in every story of the multistory building 10. Therefore, it is possible to access the common facility in the core portion 30 easily from any position in the multistory building 10.

Figure 6:
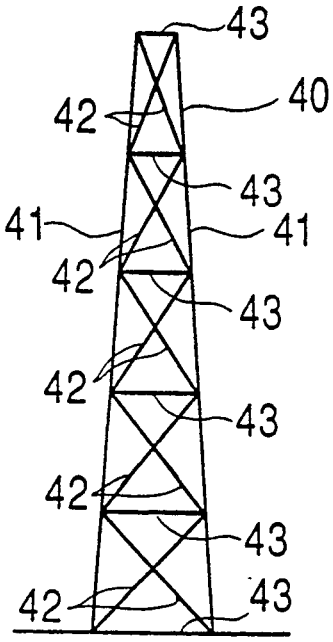
FIG. 6 is a general view showing a brace structure.
Figure 7:
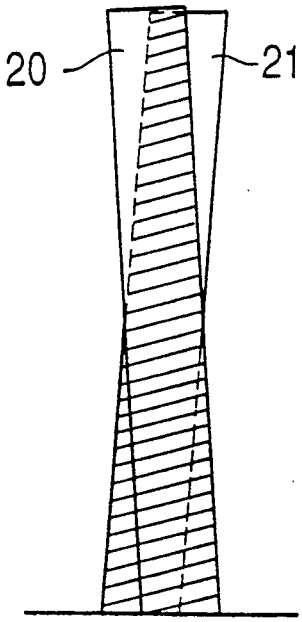
FIG. 7 is a schematic side view showing the mounting position of the brace structure shown in FIG. 6.

The brace structures 40 are disposed between the outside units 20 and 20 and the intermediate unit 21. Each brace structure 40 comprises two chord members 41 and 41 provided opposite to each other, a plurality of supporting members 43 which are spanned between the chord members 41 at intervals to couple these chord members 41, and a plurality of braces 42 provided diagonally between the chord members 41 and between adjacent supporting members 43, as shown in FIG. 6. As shown in FIG. 2, the brace structure 40 has the same height as that of the core portion 30 of the multistory building 10. One of the chord members 41 of each brace structure 40 is provided on a vertical edge of the upper inclined face of the intermediate unit 21, and the other of the chord members 41 is provided on a vertical edge of the upper inclined face of the outside unit 20. Each brace structure 40 has a symmetrical trapezoid shape in which the position is lower, the width thereof increases in the downward direction.

The supporting members 43 are provided between the chord members 41 at regular intervals. Each supporting member 43 is formed to fit the corresponding distance between the chord members 41. The length of the supporting members 43 provided at the top of the brace structure 40 is equal to that of the longer edge of the top surface of the core portion 30. The length of the supporting members 43 provided at the bottom of the brace structure 40 is equal to the rest when subtracting the length of the longer edge of the core portion 30 from twice the length of the longer edge of the outside unit 20, when viewed from the top. As shown in FIG. 6, the braces 42 are diagonally fixed on a plurality of small trapezoids formed by the chord members 41 and 41 and the supporting members 43. In each small trapezoid, braces 42 and 42 cross each other. Each brace 42 has a length corresponding to the diagonals of each trapezoid on which the brace is provided.

The brace structure 40 has a long and narrow trapezoid shape extending in the longitudinal direction of the chord members 41, as shown in FIG. 6. The supporting members 43 positioned at the top of the brace structure 40 is provided on the connecting line of the top surface of the core portion 30 and the inner lateral face of the outside unit 20. The supporting members 43 positioned at the bottom of the brace structure 40 are provided on the connecting line of the bottom surfaces of the intermediate and outside units 20 and 21, and the ground. That is, the brace structures 40 are attached between the intermediate unit 21 and the outside units 20 and 20 so that each brace structure 40 covers the range shown by oblique lines in FIG. 7.

As shown in FIG. 1, other brace structures 44 are provided on the upper and lower inclined lateral faces of the outside units 20 and 20 and the intermediate unit 21. Each of the brace structures 44 comprises two parallel chord members 45 and 45, a plurality of supporting members 46 which are spanned between the chord members 45 and 45 at intervals, and a plurality of braces 47 provided diagonally between the chord members 45 and between adjacent supporting members 46, as shown in FIG. 1.

In the multistory building 10, the outside units 20 and 20 and the intermediate unit 21 are coupled in one body, and the outside units 20 and 20 are tilted in one direction and the intermediate unit 21 is tilted in the opposite direction. The total weight of the outside units 20 and 20 and the weight of the intermediate unit 21 are approximately equal. Consequently, the moments caused by the tilt of the units 20 and 21 cancel each other out.

In the multistory building 10, the core portion 30 and a living space 50 may be structurally separated from each other. The brace structure 40 provided at the boundary portion between the core portion 30 and the living space 50, may have a shape with inclined sides corresponding to those of the outside units 20 and 20 and the intermediate unit 21. Steel columns or the like which comprise parts of external walls may be provided in a tilted direction along the inclined surface of the external wall. The shapes and arrangements of the living spaces and the core portions 30 in every story of the multistory building may be similarly so constructed.

Therefore, according to such a multistory building 10, it is possible to easily form a multistory building having the same shape and the same arrangement of the core portion 30 and the living space 50 in every story, and to reduce unused space in the outside units 20 and 20 and the intermediate unit 21 with few projection of diagonal members. Since the outside units and the intermediate unit are coupled with one another on a horizontal standard line, it is possible to secure the horizontal rigidity of the multistory building 10. Therefore, the embodiment is advantageous for design of the multistory building 10. The embodiment provides a multistory building having a visually striking appearance, without hindering building planning or equipment planning.

Furthermore, the multistory building according to this embodiment having three or more tilted units can increase the stability of the building in the horizontal direction in which the tilted units stand one behind another, and can increase the torsional rigidity of the building, in comparison with the multistory building having only two tilted units.

In the above embodiment of the present invention, only a multistory building having three units has been explained. However, the present invention can be also applied to a multistory building having two units, or to a multistory building having four or more units, so long as the units comprise two groups, one of which is tilted in one direction and the other of which is tilted in the opposite direction so that the moments according to the weights of the two groups of units cancel each other.

As described above, the multistory building according to the invention comprises a plurality of units which are disposed connectedly and side by side and stand on a horizontal standard line, wherein the units comprise two groups, one of the two groups being tilted in one direction and the other of the two groups being tilted in the opposite direction so that the forces to bring down the two groups of the units are cancelled each other. Since each unit of the multistory building of the present invention is tilted with respect to the vertical axis so as to have one upper inclined face and one lower inclined face, the building of the present invention provides an appearance of a multistory building which gives people a great shock. Furthermore, according to the multistory building of the present invention, since the moments for falling down of one and the other of the two groups of units are cancelled each other, it is possible to provide a stable multistory building in structure. Since the outside units and the intermediate unit are coupled with one another in a horizontal standard line, it is possible to secure the horizontal rigidity.

What is claimed is:

1. A multistory building comprising a plurality of units which are disposed connectedly and side by side and stand along a horizontal standard line, wherein the units comprise two groups, one of the two groups being tilted in one direction and the other of the two groups being tilted in the opposite direction so that the moments according to the weights of the two groups of units cancel each other.

2. A multistory building as claimed in claim 1, wherein one of the two groups is tilted at an angle different from that of the other group with respect to the vertical axis, the groups tilted in opposite directions so that the moments according to the weights of the two groups of units cancel each other.

3. A multistory building as claimed in claim 1, wherein a brace structure for supporting the forces in the horizontal direction which operate on both the adjacent units is provided between the adjacent units, the brace structure comprising a plurality of chord members provided opposingly and a plurality of braces provided between the chord members so that the portion on which the adjacent units overlap each other is surrounded by the brace structure in side view.

4. A multistory building as claimed in claim 1, wherein the units of the two groups are tilted at substantially the same angle with respect to the vertical axis in opposing directions.

5. A multistory building as claimed in claim 4, wherein the total weight of one of the two groups is substantially equal to the total weight of the other of the two groups.

6. A multistory building as claimed in claim 1, wherein a core portion extending vertically is provided in at least one unit in the portion on which the adjacent units overlap each other in side view, the core portion having common facilitates for the multistory building and having a vertical transport means.

7. A multistory building as claimed in claim 6, wherein the core portion is a rectangular parllelopiped.

8. A multistory building as claimed in claim 1, wherein the multistory building comprises at least three units.

9. A multistory building as claimed in claim 8, wherein the units comprise at least two outside units and an intermediate unit so that the moments according to the weights of the outside units and of the intermediate unit cancel each other.

10. A multistory building as claimed in claim 9 wherein the outside units and the intermediate unit are tilted at substantially the same angle with respect to the vertical axis in opposing directions, and the total weight of the outside units is substantially equal to the weight of the intermediate unit.

11. A multistory building as claimed in claim 9, wherein a core portion extending vertically is provided in the intermediate unit in the portion in which the adjacent units overlap each other in side view, the core portion having a rectangular parallelopiped shape and having facilities for the multistory building and a vertical transport means.

12. A multistory building as claimed in claim 9, wherein a brace structure for supporting the forces in the horizontal direction which operate on both the adjacent outside and intermediate units is provided between the adjacent units, the brace structure comprising a plurality of chord members provided opposingly and a plurality of braces provided between the chord members so that the portion on which the adjacent outside and intermediate units overlap each other is surrounded by the brace structure in side view.

13. A multistory building as claimed in claim 12, wherein each brace structure is of a symmetrical trapezoid shape with approximately the same height as that of the core portion of the multistory building, one of the chord members of which is substantially provided on a vertical edge of the upper inclined face of the intermediate unit, and the other of the chord members of which is provided on a vertical edge of the upper inclined face of the outside unit.

* * * * *